United States Patent [19]

Markovich

[11] Patent Number: 4,804,084

[45] Date of Patent: Feb. 14, 1989

[54] GARMENT BAG TRANSFORMABLE INTO A VALET

[75] Inventor: Mark J. Markovich, Iowa Falls, Iowa

[73] Assignee: Welsh Sporting Goods Corp., Iowa Falls, Iowa

[21] Appl. No.: 112,612

[22] Filed: Oct. 26, 1987

[51] Int. Cl.[4] ..... A45C 5/06; A45C 13/34

[52] U.S. Cl. ..... 206/283; 150/900; 383/33

[58] Field of Search ..... 206/279, 287, 287.1, 206/282, 283, 290, 291, 278; 150/900; 190/113, 119, 13 F; 383/33, 34

[56] References Cited

U.S. PATENT DOCUMENTS

| | | | |
|---|---|---|---|
| 1,832,715 | 11/1931 | London | 206/287 |
| 2,116,197 | 5/1938 | Gersten | 206/283 |
| 2,128,099 | 8/1938 | Marks | 206/283 |
| 2,159,959 | 5/1939 | Ballentine | 206/283 |
| 2,261,291 | 11/1941 | Salavsky | 206/287.1 X |
| 2,633,235 | 3/1953 | Marks | 206/283 |
| 2,671,706 | 3/1954 | Greengold | 206/283 X |
| 2,684,150 | 7/1954 | Kroner | 206/283 |
| 2,961,091 | 11/1960 | Enrich | 206/290 |
| 3,572,251 | 3/1971 | Johnson | 206/290 X |

*Primary Examiner*—Sue A. Weaver

*Attorney, Agent, or Firm*—Carl Schaukowitch

[57] ABSTRACT

A hanging garment bag is transformable into a valet by unfolding said garment bag and retaining the unzipped closure panels in an open, upright configuration with a retainer assembly. The retainer assembly comprises a tubular housing, two telescopic subassemblies and two attachment subassemblies. The tubular housing is encased in a fabric-like sleeve sewn to a top gusset panel within a clothing compartment. Each telescopic subassembly comprises a first telescopic arm member which slideably retracts into and slideably extends outwardly from the tubular housing and a second telescopic arm member which slideably retracts into and slideably extends outwardly from the first telescopic arm member. Each end portion of the second telescopic arm members has an attachment subassembly for releaseable attachment of the retainer assembly to the closure panels of the garment bag.

15 Claims, 3 Drawing Sheets

GARMENT BAG TRANSFORMABLE INTO A VALET

BACKGROUND OF THE INVENTION

This invention relates to a new and improved garment bag intended for packing, storing, transporting and unpacking clothing and personal effects. More particularly, this invention relates to a new and improved garment bag that can be easily packed for or partially unpacked during travel and useable as a valet for convenient access into the garment bag so that individual items of clothing and personal effects packed therein can be retrieved without substantially unpacking the garment bag.

A typical garment bag unfolds and hangs from a door, hook or closet bar. To open the unfolded, hanging garment bag, a traveler is required to unzip the split closure panels through the vertical middle of the bag. Also, the traveler detaches the split closure panels from the top gusset panel if the closure panels are attached thereto by zippers or snaps. To pack clothing such as suits, blouses and shirts which are hung from hangers, the traveler had to either fold the hanging clothing and stuff the bottom portions of the clothing into the bottom portion of the garment bag or manipulate the garment bag by hand around the clothing hanging partially therein. Folding causes undesirable creases and wrinkles in the clothing and manipulating the garment bag by hand to avoid folding of the hanging clothing is awkward for packing.

To maximize storage space, accessory compartments are typically sewn into the closure panels for packing accessories and other personal effects. For convenient access into the garment bag, the traveler unpacked at least the upper accessory compartments sewn into the closure panels. This unpacking was necessary because, when the closure panels were unzipped, the weight of the accessories in these accessory compartments caused the closure panels to obstruct access into the clothing compartment for retrieval or packing of the hanging clothing. If the closure panels remained zipped, the accessory compartments were easily accessible but at the expense of eliminating access to the clothing compartment.

Inherent in the various designs, garment bag manufacturers have long recognized the need to provide travelers with a garment bag that is easy to pack and convenient to use while travelling.

One garment bag manufacturer provides a removable closure panel for its garment bag. Now, the traveler has complete access to the clothing compartment. However, the accessories and other personal effects found in the accessory compartments sewn into the closure panel are no longer a convenient and integral part of the hanging garment bag. Either the closure panel is hung separately or placed upon a bed or dresser for access therein.

Other garment bag manufacturers provide a door-like closure panel that zips and unzips along two horizontal sides and one vertical side. The remaining vertical side which is integrally attached to one side of the garment bag acts as a hinge for ease of opening or closing the clothing compartment of the garment bag. The closure panel can be folded around to the rear of the hanging garment bag and then secured to the rear such as by using straps. Again, the traveler has full access to the hanging clothes in the clothes compartment. However, accessories and other personal effects in the accessory compartments sewn into the closure panel are completely inaccessable for the traveler because the zipper for the accessory compartment is now positioned between the outer side panels of the garment bag and the back of the closure panel. Failure to secure the weighted closure panel behind the garment bag will cause stress at the upper pivotal corner of the garment bag which may result in tearing the closure panel away from the garment bag.

Yet another manufacturer provides a garment bag having a split closure panels with a zipper extending diagonally from one corner of the top portion of the garment bag to an opposite corner at the bottom portion of the garment bag to facilitate ease of packing and unpacking. However, either the hanging clothing must be folded for packing or the garment bag must be manipulated by hand to pack hanging clothing. Further, if the closure panel that opens into or closes the clothing compartment has an accessory compartment attached, it must be unpacked or the traveler will risk the possibility of tearing the closure panel at the upper pivotal corner of the garment bag.

It is from these considerations and others that the present invention evolved.

SUMMARY OF THE INVENTION

The present invention provides significant improvements and advantages over prior art garment bags, particularly with respect to its inherent characteristics of being transformable into a valet for ease of retrieving individual items packed therein and providing convenient access to the hanging clothing and accessory compartments for packing and unpacking.

Generally summarized, the new and improved garment bag hanging from a door, hook, clothes bar or the like transforms into a valet when vertically-split closure panels are held in an opened, upright configuration from the clothing compartment by a retainer assembly. The retainer assembly comprises a tubular housing, two telescopic subassemblies and two attachment subassemblies. Each telescopic subassembly comprises a first telescopic arm member and a second telescopic arm member. The first telescopic arm slideably extends outwardly from and slideably retracts inwardly into the tubular housing. The second telescopic arm member slideably extends outwardly from and slideably retracts inwardly into the first telescopic arm member. The retainer assembly is affixed to the garment bag by snug-fitting the tubular housing into a fabric-like sleeve which is sewn to and behind the upper gusset panel. In its stow position, the retainer assembly and sleeve are positioned behind the upper gusset panel and the telescopic subassemblies are substantially contained within the tubular housing. In its operable position, the retainer assembly pivots from behind the upper gusset panel in its sleeve and the first and second telescopic arm members of each telescopic subassembly extend outwardly from the respective tubular openings and transversely from the side gussets so that the attachment subassemblies affixed onto end portions of the second telescopic arm members can be attached to each closure panel to retain the closure panels upright and away from the opening to the clothing compartment.

The present invention is described and shown in greater specificity in the following detailed description of the invention and in drawings. Comprehension of the various aspects of the invention should lead to an increased appreciation for the significance of the invention and its advancement of the prior art.

BRIEF DESCRIPTION OF THE DRAWINGS

Other objects, advantages and capabilities of the present invention will become more apparent as the description proceeds, taken in conjunction with the accompanying drawings, in which.

DESCRIPTION OF THE PREFERRED EMBODIMENT

Figure 1:
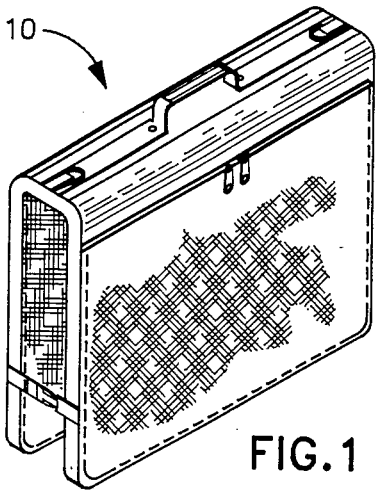
FIG. 1 is a perspective view of a typical garment bag in its folded and closed configuration.
Figure 2:
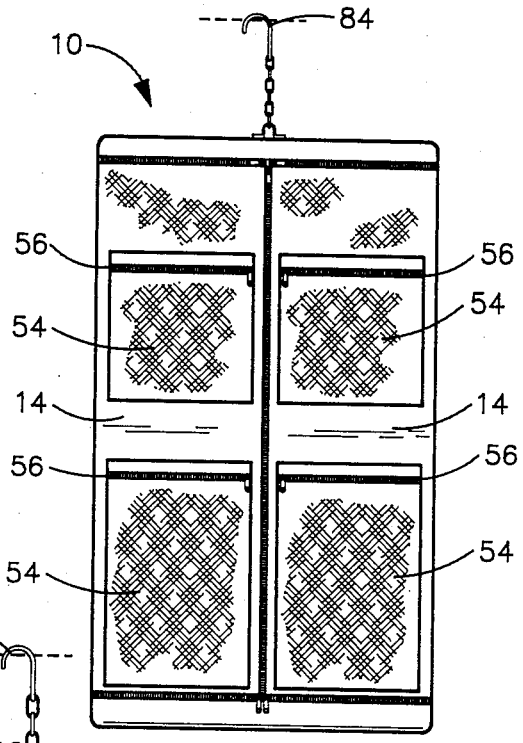
FIG. 2 is a front elevational view of the typical garment bag shown in FIG. 1 in its unfolded, yet closed, configuration.
Figure 3:
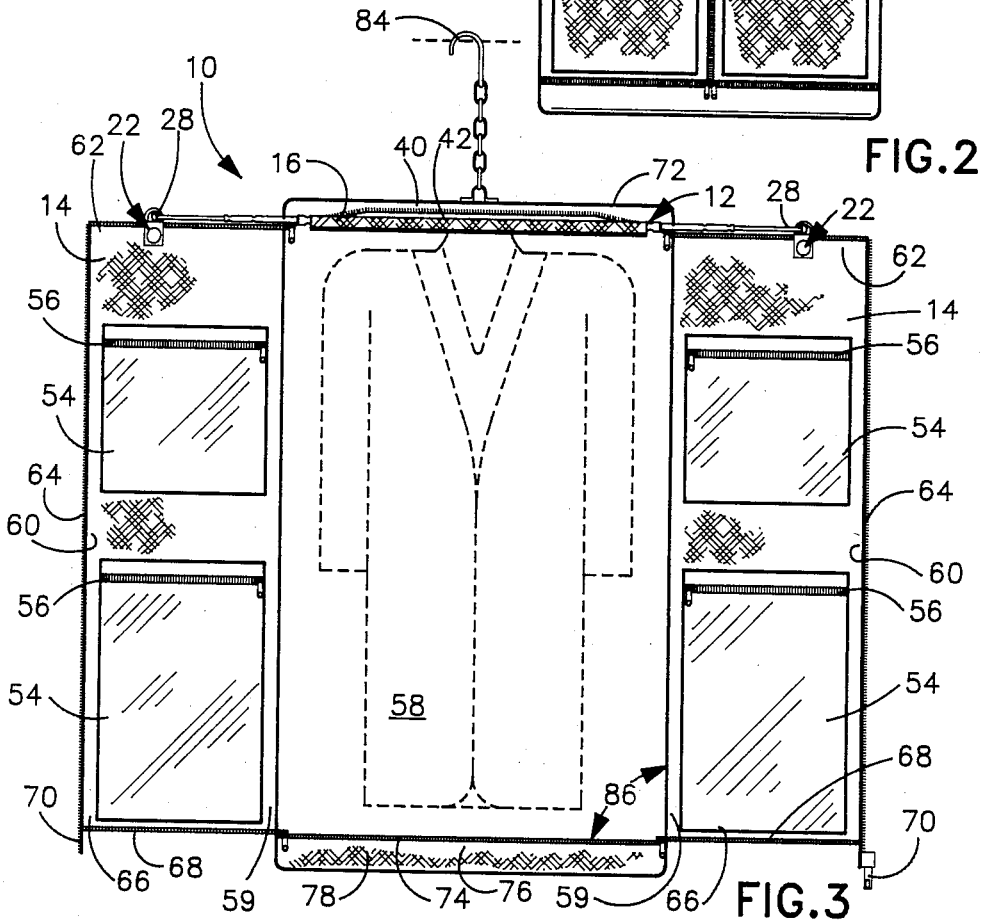
FIG. 3 is a front elevational view of the garment bag shown in FIG. 2 in its unfolded and opened configuration incorporating the present invention.
Figures 4, 5, 6:
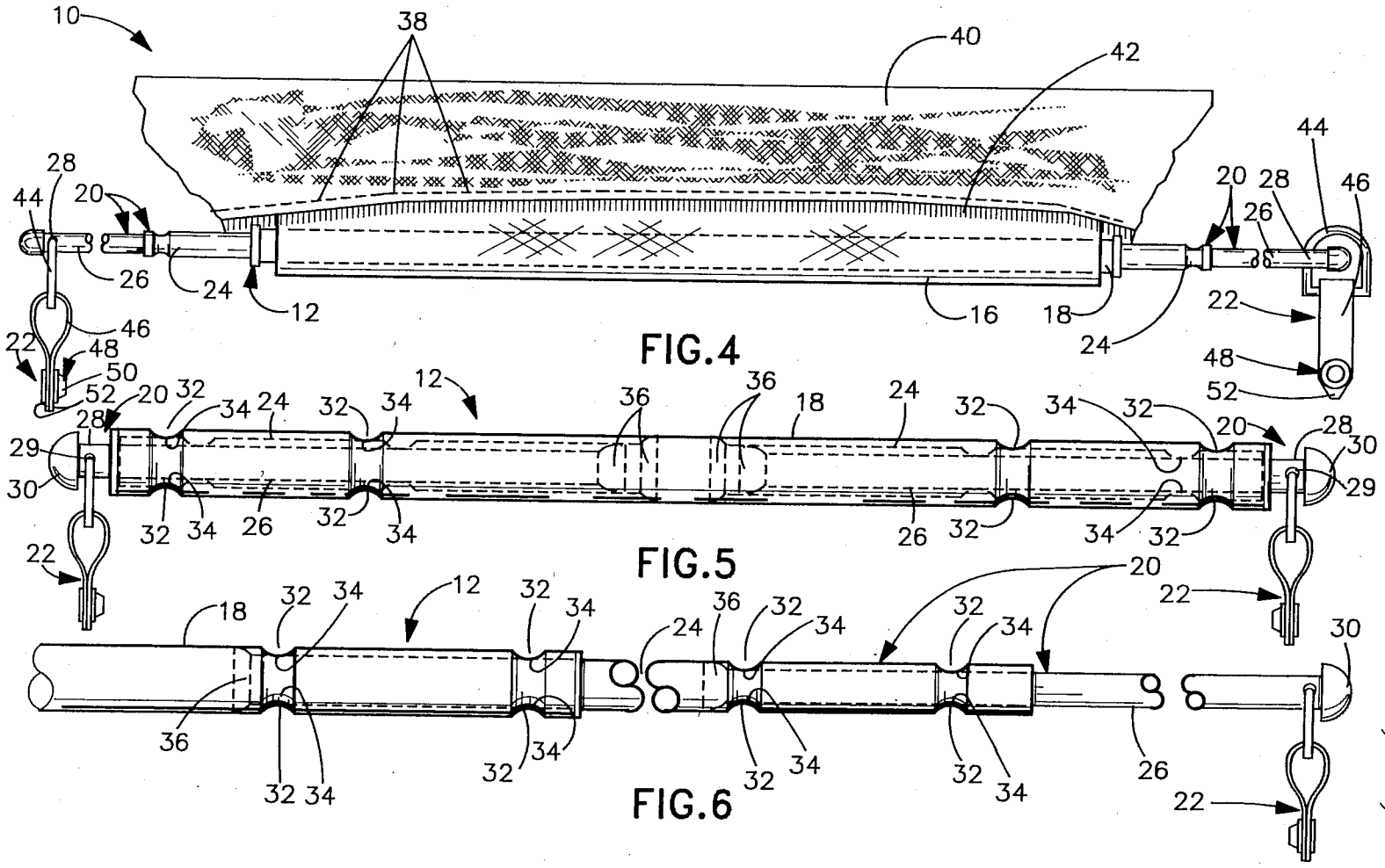
FIG. 4 is a front elevational view of a top portion of the garment bag shown in FIG. 3 illustrating details of the present invention.
FIG. 5 is a front elevational view of the retainer assembly as shown in FIG. 4 in its stow position.
FIG. 6 is a front elevational view of one half of the retainer assembly shown in FIG. 5 in its fully-extended, operable position.

A garment bag 10 appears to be a typical garment bag as shown in FIGS. 1 and 2. However, as best shown by FIG. 3, the garment bag 10 incorporates a retainer assembly 12 to suspend and retain closure panels 14 in an opened, upright configuration. As shown in FIG. 4, the retainer assembly 12 attaches to the garment bag 10 by a fabric sleeve 16 and comprises a tubular housing 18, two telescopic subassemblies 20 and two attachment subassemblies 22. Each telescopic subassembly 20 comprises a first telescopic arm member 24 and a second telescopic arm member 26. Both telescopic arm members 24 and 26 are seamless tubes made from a formable metal such as brass or aluminum.

The retainer assembly 12 shown in FIG. 5 is disposed in its stow position in that both telescopic subassemblies 20 are substantially contained within the tubular housing 18. The tubular housing 18, a seamless tube made from a formable metal such as brass or aluminum, slideably receives the first telescopic arm member 24 and the first telescopic arm member 24 slideably receives the second telescopic arm member 26. Only an end portion 28 of each second telescopic arm member 26 extends slightly beyond an opening (not shown or numbered) into the tubular housing 18 because the attachment subassemblies 22 are affixed to the end portions 28 through an eyelet 29 and is capped by a cap 30. The cap 30 is optional because its primary function is to add aesthetic value to the end portion 28 of each second telescopic arm member 26.

The retainer assembly 12 is viewed in FIG. 6 in its operable position as a half assembly for clarity purposes only; it should be understood that the remaining, opposite half assembly operates identically as the half assembly viewed in FIG. 6. The retainer assembly 12 is disposed in its operable position in that the telescopic subassembly 20 is fully extended. In other words, the second telescopic arm member 26 is slideably extended outwardly from the first telescopic arm member 24 and the first telescopic arm member 24 is slideably extended outwardly from the tubular housing 18.

As best shown in FIGS. 5 and 6, the tubular housing 18 is formed with two sets of two grooves 32 adjacent both ends. Likewise each first telescopic arm member 24 is formed with a set of two grooves 32 adjacent one end. Because the tubular housing 18 and the first telescopic arm members 24 are hollow tubes, the grooves 32 extend circumferentially therearound. Correspondingly, two sets of two circular ridges 34 are formed into the interior of the tubular housing 18 and one set of two circular ridges 34 are formed into the interior of each first telescopic arm member 24. These ridges 34 provide a tight clearance yet a slidable fit and alignment between the tubular housing 18 and the first telescopic arm member 24 as well as between the first telescopic arm member 24 and the second telescopic arm member 26.

Shown in FIGS. 5 and 6, end portions 36 of both the first and second telescopic arm members 24 and 26 respectfully are flared. Flaring provides several advantages. It prevents the second telescopic arm member 26 from accidently being slid or pulled out of the first telescopic arm member 24 and prevents the first telescopic arm member 24 from accidently being slid or pulled out of the tubular housing 18. A tight clearance yet slidable fit and alignment are achieved between the tubular housing 18 and the first telescopic arm member 24 as well as between the first telescopic arm member 24 and the second telescopic arm member 26. Further, it is theorized that the flared end portions 36 when contacting the ridges 34 provide a locking capability when enough force is applied outwardly upon extending the telescopic subassemblies 20. Such locking is advantageous because upon full extension of the telescopic subassemblies 20, the first and second telescopic arm members 24 and 26 respectively tend to maintain their fully-extended, operable positions.

As best shown in FIG. 5, each set of two ridges 34 is strategically disposed so that a portion (not numbered) of the first telescopic arm member 24 remains in the tubular housing 18 when fully extended and a portion (not numbered) of the second telescopic arm member 26 remains within the first telescopic arm 24 when fully extended. This provides additional bending moment strength to the retainer assembly 12 when the telescopic subassemblies 20 are fully extended and are attached to the closure panels 14.

As best shown in FIG. 4., the retainer assembly 12 is cradled by the fabric sleeve 16 for attachment to the garment bag 10. The sleeve 16 fabricated from an elasticized material is sewn longitudinally as indicated by stitches 38 along a top gusset panel 40 and adjacent a top gusset zipper track 42.

The end portion 28 of each second telescopic arm members 26 is affixed to one attachment subassembly 22 for releaseably attaching the closure panels 14 to the retainer assembly 12 as shown in FIG. 3. In FIG. 4, each attachment assembly 22 comprises a D-ring 44, a leather tab 46 folded through the D-ring 44 and standard snap 48 having a male portion 50. The D-ring 44 is retained to the end portion 28 of each second telescopec arm member 26 through the eyelet 29. The leather tab 46 is folded through the D-ring 44 to form two leather end portions 52 which are retained together by riviting the snap 48 thereto. In addition to the releasable attachment function, the attachment subassemblies 22 prevent an undesirable occurrence if the end portions 28 completely retract into the tubular housing 18 and/or into the first telescopic arm member 24. Also, the attachment subassemblies 22 provide a convenient means for a traveler to grasp the telescopic subassemblies 20 to extend the retainer assembly 12 from its stow position (shown in FIG. 5) to its operable position (shown in FIG. 6).

As shown by FIGS. 2 and 3, each of the closure panels 14 has accessory compartments 54 sewn thereto. As viewed in FIG. 2 where the garment bag 10 is unfolded, yet closed, the traveler may access any of the accessory compartments 54 by unzipping an appropriate accessory compartment zipper 56. In this configuration, the accessory compartments 54 are shown to be fabricated from the identical material as the garment bag to maintain the privacy of the contents contained therein. In FIG. 3 where the garment bag 10 is fully opened to expose a clothing compartment 58 and the closure panels 14 are suspended and retained opened and upright by the retainer assembly 12, the traveler may access any of the accessory compartments 54 by unzipping the appropriate accessory compartment zipper 56. In this configuration of the garment bag, the accessory compartments 54 are shown to be fabricated from a transparent vinyl material so that the traveler can identify exactly where the desired accessory item is located before its retrieval. Note that whether the garment bag 10 is unfolded and opened or closed, the traveler is afforded easy access into the accessory compartments 54 with having accessory compartment zippers 56 sewn on both sides of the accessory compartments 54. Also, the traveler can see through the transparent vinyl material to determine exactly where the desired accessory items are located when the garment bag 10 is in its unfolded and opened configuration. The garment bag 10 acts as a valet when it is hung in its unfolded and opened configuration from a door, hook or closet bar and its closure panels 14 are retained opened, upright and away from the clothing compartment 58 by the retainer assembly 12 extended in its operable position.

Each of the closure panels 14 is sewn to the garment bag 10 along a first longitudinal edge 59 as shown in FIG. 3. A second longitudinal edge 60 and a top lateral edge 62 of each closure panel 14 are sewn to a closure zipper track 64. A bottom lateral edge 66 is sewn to a bottom zipper track 68. Bottom end portions 70 of each closure zipper track 64 extend below the bottom lateral edges 66 of the closure panels 14 to facilitate ease in zipping the closure panels 14 closed as well as to maintain aesthetics of the garment bag 10 when zipped closed as shown in FIG. 2.

Shown in FIG. 3, the top gusset zipper track 42 is sewn along an edge 72 of the top gusset panel 40 for zipping or unzipping both of the closure zipper tracks 64 sewn to the top lateral edges 62 of the closure panels 14. A bottom gusset zipper track 74 is sewn along an edge 76 of a bottom gusset panel 78 for zipping or unzipping both of the bottom zipper tracks 68 thereto.

Figure 7:
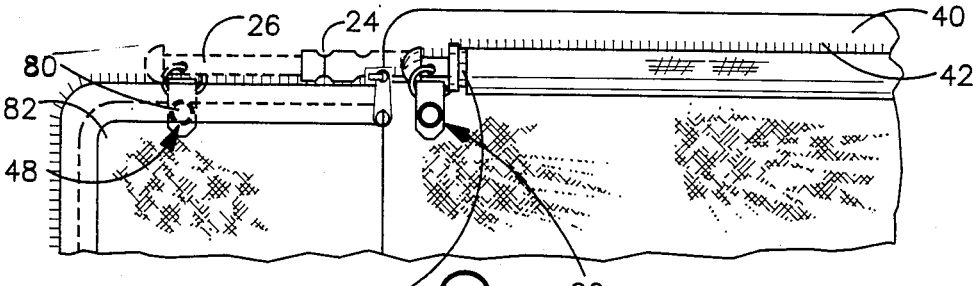
FIG. 7 is a front elevational view of one half of the present invention shown in its stow position and phantomly in its operable position as illustrated in FIG. 4.

As best shown by FIG. 7, a female portion 80 of the snap 48 is located adjacent top closure panel corners 82 of each closure panel 14. The female portion 80 of the snap 48 receives the male portion 50 of the snap 48 to provide releasable attachment of the closure panels 14 to the retainer assembly 12.

As shown by FIG. 1, the new and improved garment bag 10 appears to be a typical garment bag. Upon unfolding the garment bag 10 into its hanging but closed configuration, as shown by FIG. 2, the closure panels 14 are fully zippered closed. In this configuration, the garment bag 10 is typically hung from a door, hook or closet rod represented by the dashed line extending underneath and to a garment bag hook 84. Unzippering the closure panels 14 and pivoting the same into an opened and upright configuration, as shown in FIG. 3, the traveler pivots the retainer assembly 12 from behind the top gusset panel 40 and the top gusset zipper track 42, as best shown by FIGS. 3, 4 and 7, and pulls each of the telescopic subassemblies 20 and/or the attachment subassemblies 22 to extend the telescopic arm members 24 and 26 from the tubular housing 18 into their fully-extended, operable positions as shown by the phantomly drawn representation in FIG. 7. The attachment assemblies 22 on each second telescopic arm member 26 are attached to the female portions 80 of the snaps 48 by squeezing the male portions 50 of the snaps 48 into the female portions 80. Thus, the closure panels 14 are now releaseably attached to the retainer assembly 12 which, in turn, suspends and retains the closure panels 14 opened, upright and away from an opening 86 into the clothing compartment 58. The opening 86 is defined by each of the first longitudinal edges 59 of the closure panels 14, the top gusset zipper track 42 and the bottom gusset zipper track 74. With the garment bag now hanging as a valet, the traveler has substantially full, unobstructed and convenient access into the clothing compartment 58 without interference from the closure panels 14. The hanging clothing therein (represented in FIG. 3 by the phantomly drawn coat) can be inserted into or removed from the clothing compartment 58 without folding or otherwise wrinkling the same and without manipulating the garment bag 10 by hand while inserting the hanging clothing thereto. Furthermore, because the transparent vinyl material of the accessory compartments 54 face the traveler when the garment bag is hung as a valet, any one individual item can be removed from the accessory compartments 54 when the traveler sees the particular item desired without having to check or otherwise unpack each of the accessory compartments 54 until the desired item is found.

Figure 8:
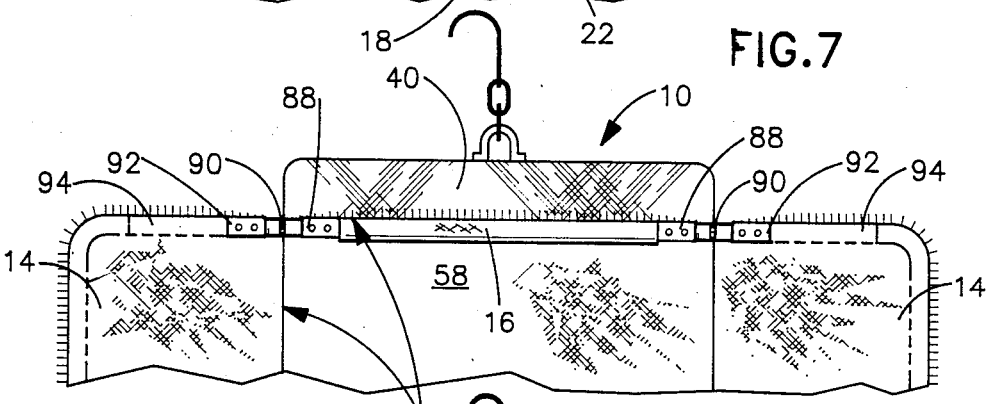
FIG. 8 is a front elevational view of a top portion of the garment bag shown in FIG. 3 incorporating an alternative embodiment of the present invention.
Figure 9:
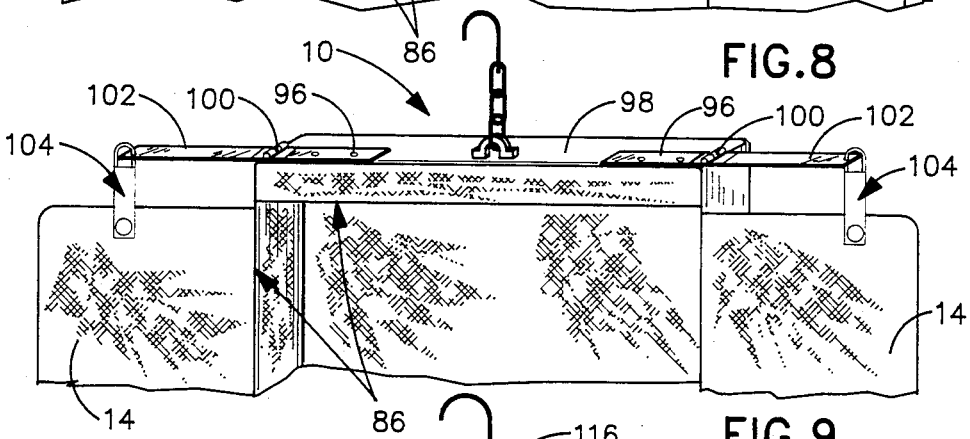
FIG. 9 is a front elevational view of a top portion of the garment bag shown in FIG. 3 incorporating an alternative embodiment of the present invention.
Figure 10:
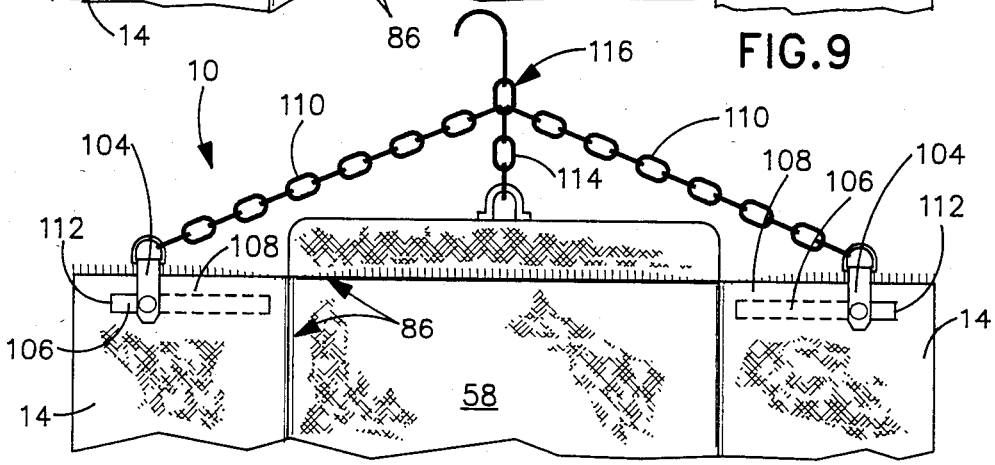
FIG. 10 is a front elevational view of a top portion of the garment bag shown in FIG. 3 incorporating an alternative embodiment of the present invention.

FIGS. 8, 9 and 10 represent alternative embodiments of the present invention which also facilitate suspension of the closure panels 14 in an opened, upright configuration and away from the opening 86 into the clothing compartment 58.

In FIG. 8, the retainer assembly comprises a bar member 88 having hinges 90 at both ends which pivotally attach to extension members 92. A portion of each extension member 92 is received by a pocket 94 sewn into each closure panel 14. The bar member 88 is received by the sleeve 16 which, in turn, secures the retainer assembly to the garment bag 10 at the top gusset panel 40.

In FIG. 9, the retainer assembly comprises two sets of a bar member 96 rigidly attached to a top gusset 98 of the garment bag 10. One end of each bar member 96 is pivotally attached by a hinge 100 to an extension member 102 having an attachment subassembly 104 attached at an opposite end for releaseable attachment to the closure panels 14.

In FIG. 10, the retainer assembly comprises a chain and stave system. The staves (not shown) are received by pockets 106 to provide rigid support to the top lateral edges 108 of the closure panels 14. One end of a chain 110 releasably attaches to the corners 112 of with closure panels 14 with the attachment subassemblies 104 while the other ends of the chain 110 attaches to the chain 114 of the garment bag hanger assembly 116.

Metal was chosen as the primary material for the preferred embodiment of the present invention but the telescopic subassemblies, the tubular housing and certain components of the attachment assembly could be made from other materials such as plastic or composite. Furthermore, the second telescopic arm member was fabricated from a seamless metal tube for the preferred embodiment of the present invention although the same can be fabricated from a solid bar. Therefore, the selection of fabrication materials should not be construed as a limitation of the present invention.

The preferred embodiment of the present invention and its significant advantages and advancements over prior art have been described with a degree of specificity. It should be understood, however, that the specificity of description has been made by way of example only and that the scope of the invention falls within the scope of the appended claims.

I claim:

1. An improved garment bag having a top gusset and at least one closure panel pivotally attached to a side gusset of said garment bag, the improvement comprising:

a rigid housing;

means including at least one rigid arm member slideably extendable from and slideably retractable into said housing, said arm member having an end portion;

a means for releasable attachment of said end portion of said arm member to said closure panel; and a means to attach said housing to said garment bag.

2. An improved garment bag as defined in claim 1, wherein:

said housing is tubular.

3. An improved garment bag as defined in claim 1, wherein:

said means to attach said housing to said garment bag is a sleeve.

4. An improved garment bag as defined in claim 3, wherein:

said sleeve cradles said housing.

5. An improved garment bag as defined in claim 4, wherein:

said sleeve is fabric.

6. An improved garment bag as defined in claim 4, wherein:

said sleeve is an elasticized fabric.

7. An improved garment bag as defined in claim 6, wherein:

said sleeve is sewn to said garment bag.

8. An improved garment bag as defined in claim 7, wherein:

said sleeve is sewn to said garment bag at said top gusset.

9. An improved garment bag as defined in claim 1, wherein:

said arm member slideably extends outwardly from said housing and transversely beyond said side gusset.

10. An improved garment bag having a top gusset and two vertically-split closure panels, each being pivotally attached to an opposing side gusset of said garment bag, the improvement comprising:

a rigid housing;

a means to attach said housing to said top gusset;

means including at least two rigid arm members slideably extendable outwardly from and slideably retractable inwardly into said housing, each of said arm members having an end portion; and a means for releasable attachment of each of said end portions of said arm members to each of said closure panels, whereupon opening said garment bag, each of said two rigid arm members is slideably extended outwardly from said housing and transversly beyond said side gusset and is releaseably attached to each of said closure panels to retain said closure panels in an open, upright configuration and, whereupon closing said garment bag, each of said two arm members is detached from each of said closure panels and is slideably retracted inwardly into said housing whereby both of said end portions are disposed between said side gussets for stowing said housing and said two arm members within said garment bag.

11. An improved garment bag as defined in claim 10, wherein:

said housing is tubular.

12. An improved garment bag as defined in claim 10, wherein:

said means to attach said housing to said top gusset is a sleeve.

13. An improved garment bag as defined in claim 12, wherein:

said sleeve cradles said housing.

14. An improved garment bag as defined in claim 13, wherein:

said sleeve is fabric.

15. An improved garment bag as defined in claim 13, wherein:

said sleeve is an elasticized fabric.

* * * * *